United States Patent [19]

Davidson et al.

[11] Patent Number: 4,922,637

[45] Date of Patent: May 8, 1990

[54] STEAM IRONING PRESS #1

[75] Inventors: Donald R. Davidson, Chatham; Pao-Ter Huang, Edison; H. David Rogers, Fanwood, all of N.J.

[73] Assignee: SSMC Inc., Fairfield, N.J.

[21] Appl. No.: 388,126

[22] Filed: Jul. 31, 1989

[51] Int. Cl.[5] ..... D06F 71/34

[52] U.S. Cl. ..... 38/15; 38/36

[58] Field of Search ..... 38/15, 36, 5, 1 C, 1 D; 108/115

[56] References Cited

U.S. PATENT DOCUMENTS

| | | | |
|---|---|---|---|
| 1,205,654 | 11/1916 | Mundy | 38/36 X |
| 1,654,332 | 12/1927 | Ledbetter | 38/15 |
| 1,732,890 | 10/1929 | High | 38/15 |
| 2,307,370 | 1/1943 | Hale | 38/15 |
| 3,084,462 | 4/1963 | Purpura | 38/36 |

*Primary Examiner*—Henry S. Jaudon

*Assistant Examiner*—Ismael Izaguirre

*Attorney, Agent, or Firm*—Theodore Jay

[57] ABSTRACT

A steam iron press employs first and second members and a lever mechanism connected to a second member and when manually actuated by an operator causing the second member to be moved to any position between a position of maximum separation and a position of engagement with respect to the first member. The second member receives water and converts the water into steam which is expelled through openings therein. A pump connected between the second member and a water reservoir feeds water to the second member. A cam mechanism is connected between the lever mechanism and the pump to only actuate the pump during a predetermined interval t between the instant of time T1 at which the lever mechanism has initiated movement of the second member towards the first member and the instant of time T2 at which the article to be pressed is to be squeezed between the two surfaces.

4 Claims, 6 Drawing Sheets

STEAM IRONING PRESS #1

CROSS REFERENCE TO COPENDING APPLICATIONS

This application is related to copending applications respectively entitled Steam Ironing Press, Ser. No. 388,125 and Steam Ironing Press, Ser. No. 388,124, all three applications being owned by a common assignee and bearing the same filing date.

BACKGROUND OF THE INVENTION

One type of portable steam ironing press well known in the art utilizes upper and lower members movable with respect to each other whereby when an article to be pressed is disposed between the members, the article is squeezed therebetween and is pressed using heat and steam supplied with appropriate timing via one of the members.

The present invention is directed toward steam ironing presses of this type and incorporates a new and improved apparatus for developing and utilizing heat and steam for pressing and for controlling the timing of delivery of the heat and steam as well as the amount thereof so that the efficiency of this press is substantially increased as compared to known presses. Moreover, an operator is afforded a much greater range of control of the pressing operation than heretofore available in known presses.

SUMMARY OF THE INVENTION

In accordance with the principles of the invention, a steam iron press adapted to press an article of fabric utilizes first and second generally horizontal members. The first member is fixed in position and has an exposed upper surface. The second member has an exposed lower surface with orifices therein and is movable toward and away from the first member so that the exposed lower surface is moved toward and away from the exposed upper surface.

The article to be pressed is disposed removably upon the upper surface of the first member, the pressing action ensuing when the second member is moved toward the first member until the article is squeezed between the two exposed surfaces.

The press incorporates a first manually operatable mechanism which is connected to the second member. When manually activated by an operator, the first mechanism causes said second member to be moved to any position between a position of maximum separation and a position of minimum separation (engagement) with respect to the first member.

The second member is provided with means for receiving water supplied thereto and for heating the water into steam. The steam is expelled through openings in the exposed lower surface. This means also heats the lower surface so that the article, when squeezed has orifices through which the steam is expelled. This means also heats the lower surface so that the article, when squeezed, is pressed using heat and steam.

The press has incorporated therein a water reservoir containing water, and a pump connected between the second member and said reservoir. The pump when actuated feeds water under pressure from the reservoir to the steam generating means and when deactuated prevents water from flowing from the reservoir to the means.

The press also incorporates a second mechanism for actuating the pump during a predetermined interval t between the instant of time T1 at which the mechanism has initiated movement of the second member toward the first member and the instant of time T2 at which the article is squeezed between the two surfaces. The duration of the interval t is less than that of the interval (T2−T1). The second mechanism otherwise deactuates the pump.

The interval t can begin at an initial instant of time which occurs after T1 and end at a final instant of time which occurs prior to or coincident with T2.

The initial instant of time of the interval t can occur after the movement of the second member toward the first member has begun and the final instant of time of the interval t can occur prior to the initiation of the squeezing action whereby the steam expelled from the orifices can penetrate the entire article prior to the initiation of the squeezing action.

DETAILED DESCRIPTION OF PREFERRED EMBODIMENT

Figure 1:
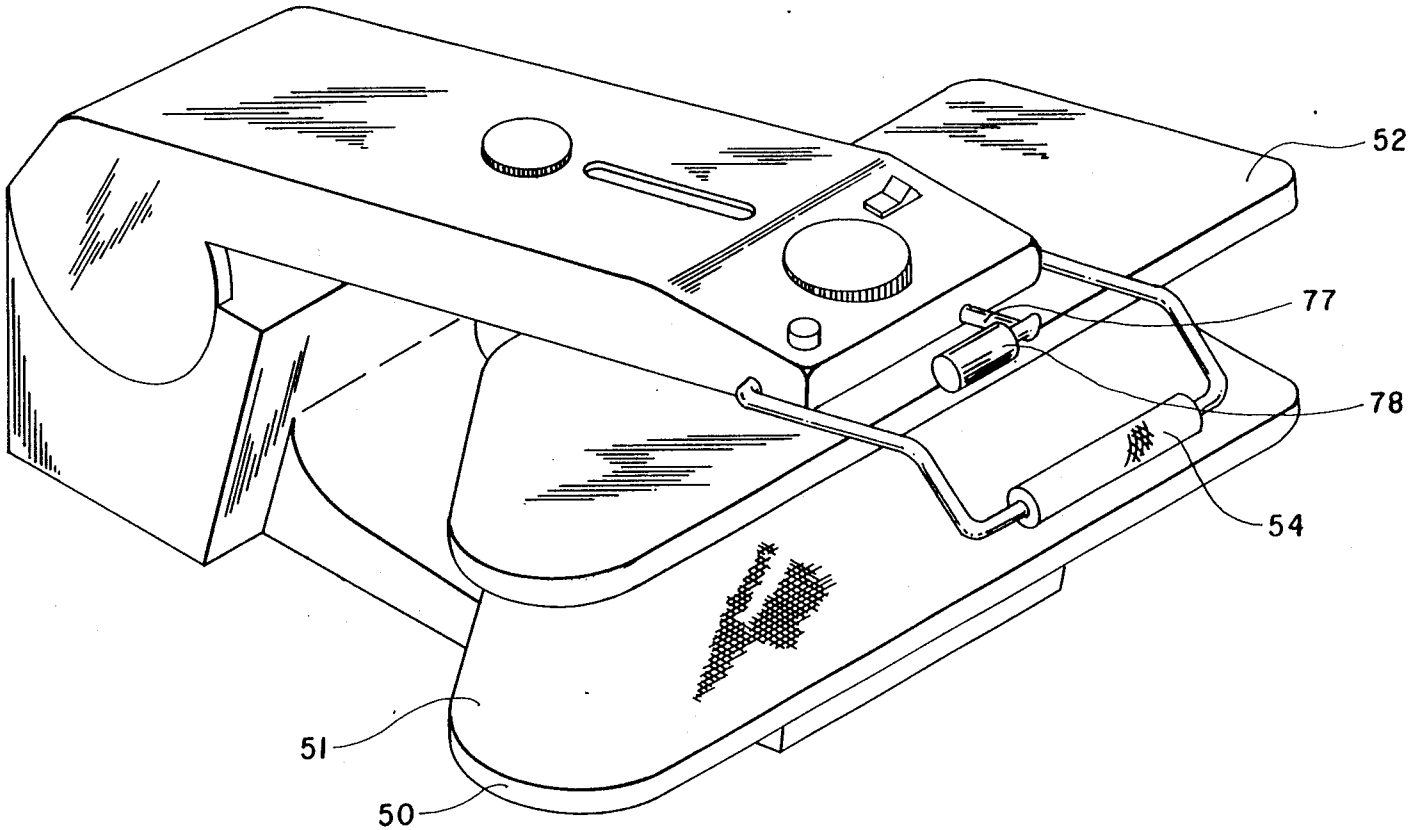
FIG. 1 is a perspective view of a preferred embodiment of the invention.
Figure 2:
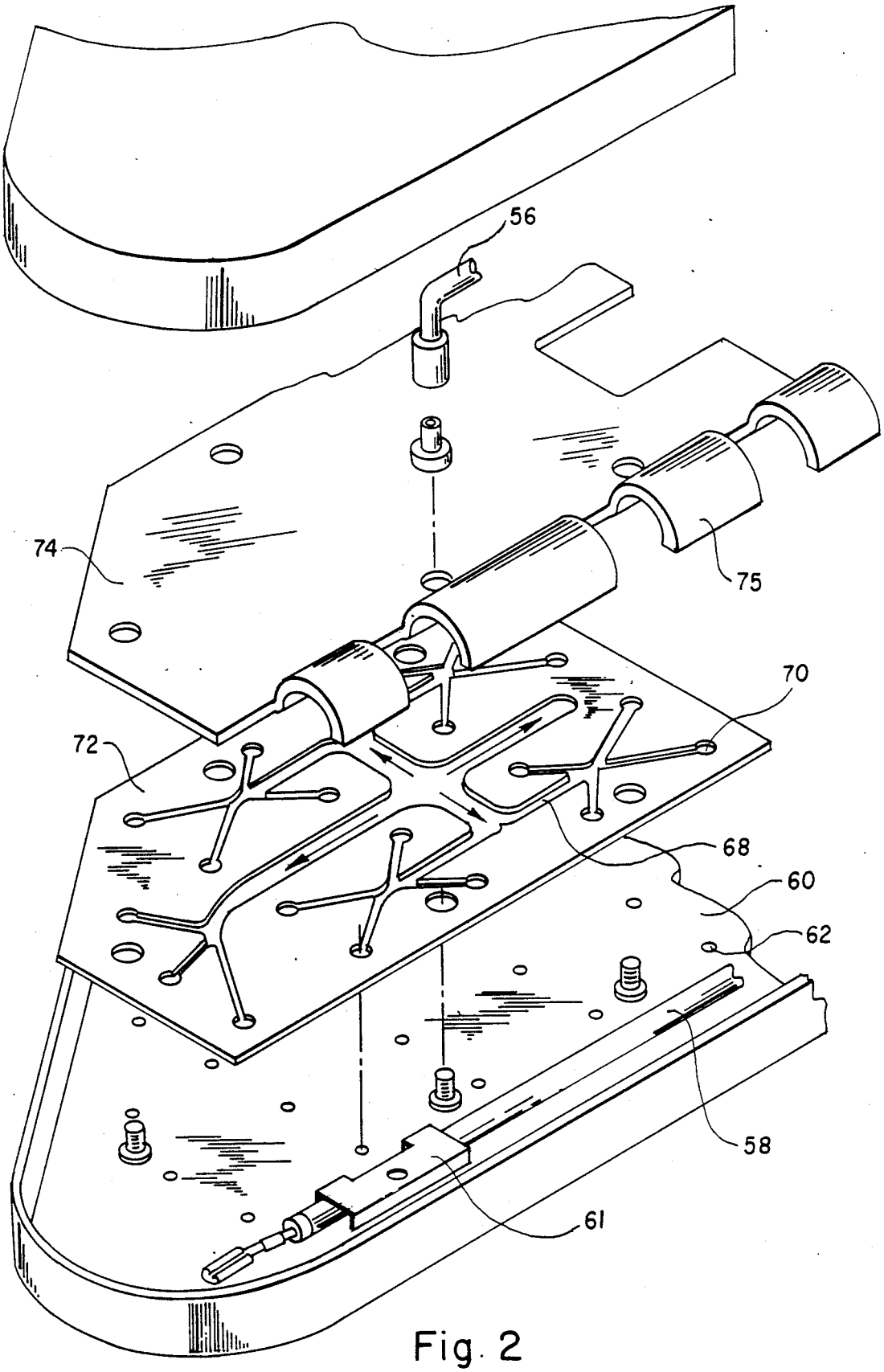
FIG. 2 is an exploded and cutaway view of certain parts contained in the upper member employed in this embodiment.
Figure 3:
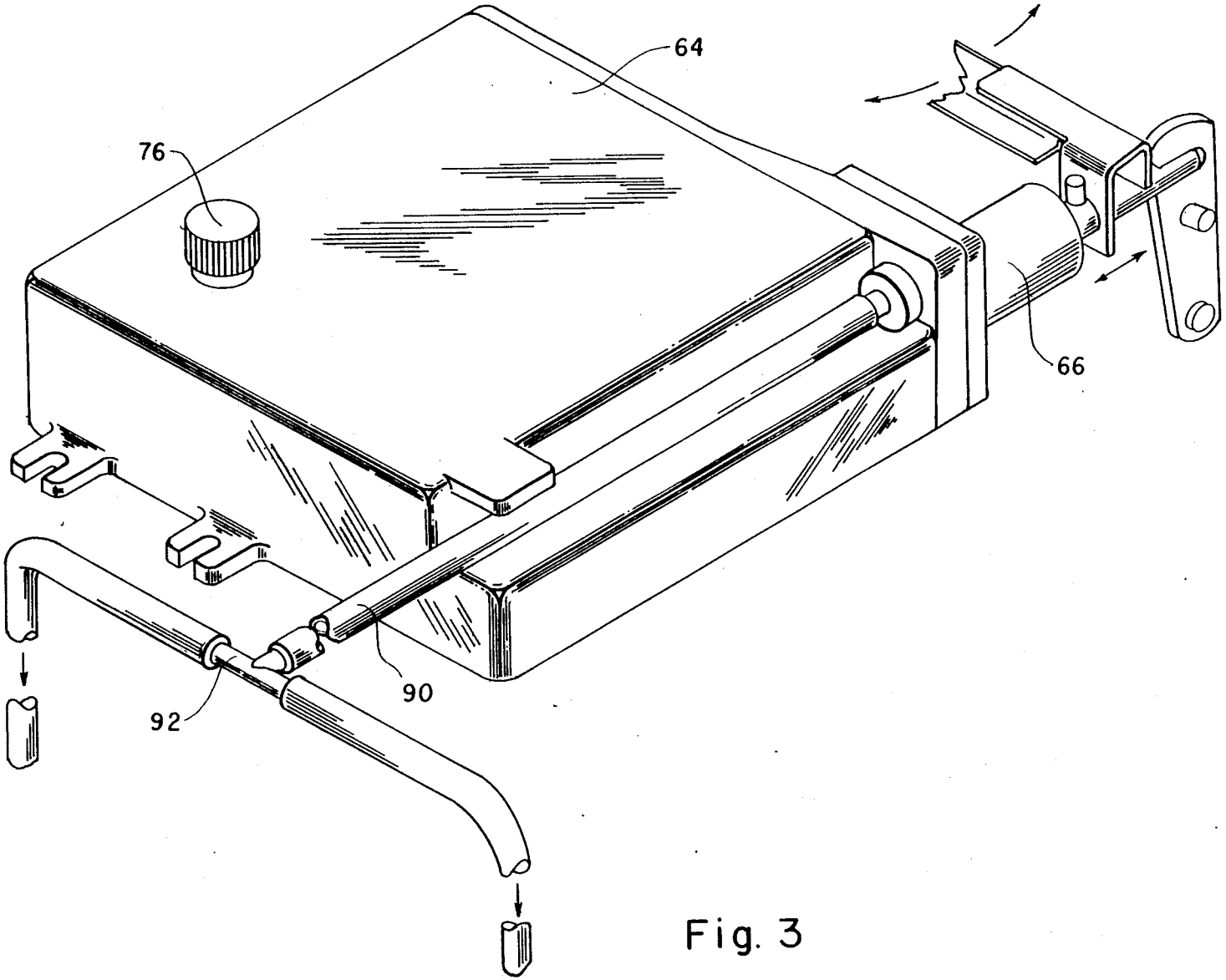
FIG. 3 is a perspective view of the water reservoir and pump empolyed in this embodiment.
Figure 4:
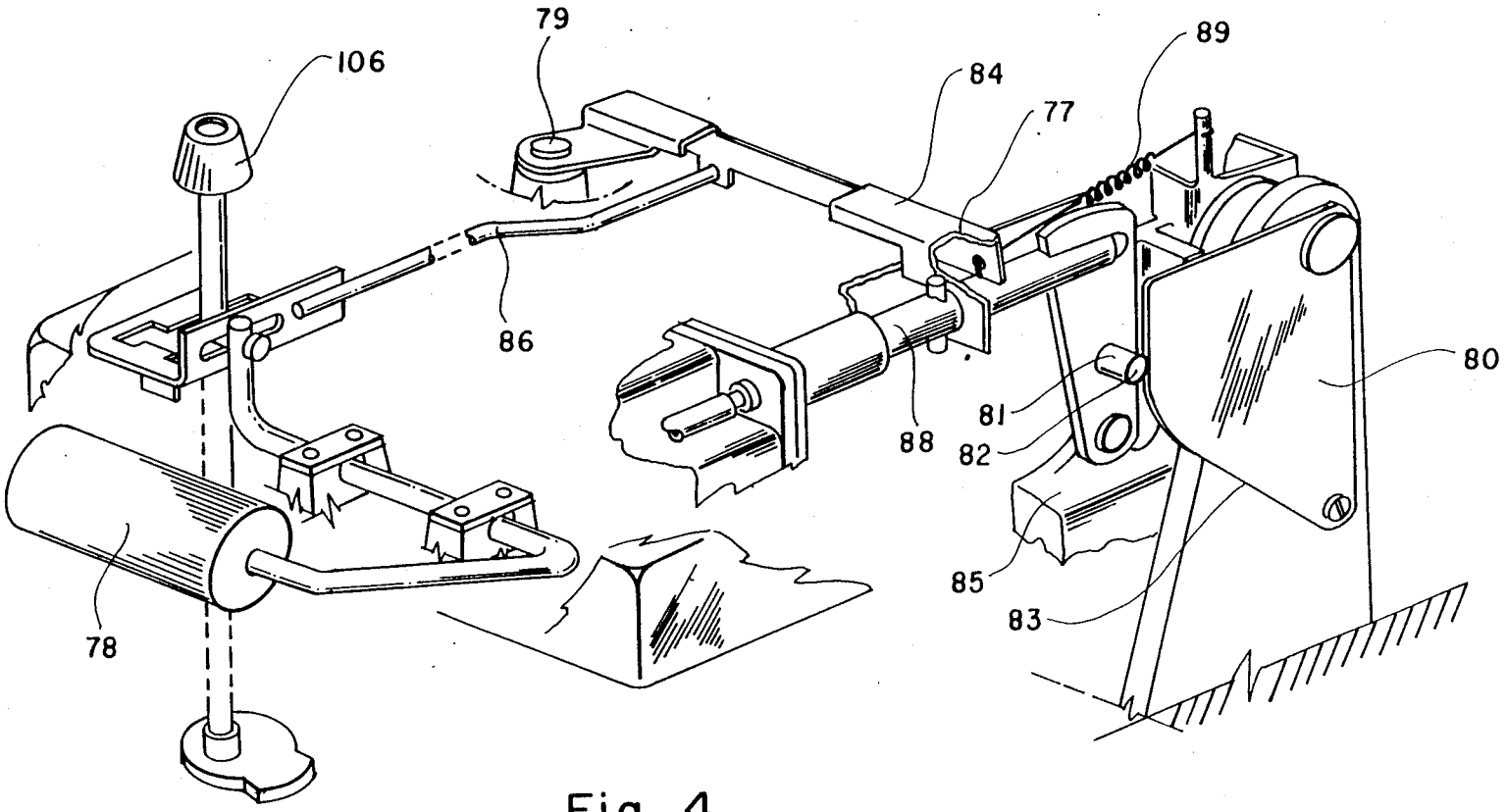
FIG. 4 is a detail cut away view of the cam and associated components employed in this embodiment.

Referring first to FIGS. 1–4, the steam press employs a stationary lower member 50 having an exposed upper surface 51 and a movable upper member 52 containing an ironing plate or platen 60 having an exposed lower surface. Plate 60 contains holes 62 through which steam can flow. A handle 54 secured to member 52 can be used to manually move the member 52 toward and away from member 50. The handle and members are so balanced that the member can be used to move the member 52 to any position between a position of maximum separation and a position of minimum separation (engagement) with respect to member 50.

A labyrinth plate 72 is disposed between platen 60 and an upper cover plate 74. Plate 72 contains pathways or cut out channels 68 which terminate in outlet holes 70 which are aligned with holes 62 in the platen. The formed labyrinth has a thickness on the order of one millimeter. The longitudinal edges of plate 72 are inwardly offset from the platen. The platen carries one or more electrically energized elongated heating rods 58 which are held in place by a plurality of clamps 61. Curved elements 75 integral with the cover plate 74 are positioned over the clamps so that heat emitted from the upper portions as well as the lower portions of rods 58 is directed downward upon the plate 72 and platen 60. This improves the efficiency of the system by concentrating the heat generated upon the plate and platen and increasing the rate of steam generated. If desired, another rod can be disposed along the opposite longitudinal edge of plate 72 and be supported by additional elements 75 in the same manner.

When water is pumped downwardly in a manner described below through pipes 56 into the center of channels 68, water droplets in the channels are forced by their affinity to the heated surfaces to advance through the labyrinth gaining heat and deteriorating in size and are converted to steam prior to emission via holes 70. Consequently steam is discharged through the platen openings. The force of discharge of steam is generated by the thermodynamic pressure of the process.

Water to be converted to steam is stored in a water tank 64 located in the press. The tank can be filled by an inlet port 76 located in the top of the tank and can be drained through a stop-cock type valve located at the bottom of the tank. The tank can be formed of transparent plastic so that the water level can be determined visually. Water pump 66, when its piston 88 is appropriately actuated, pumps water out of the reservoir via discharge line 90 and a discharge tee 92 to pipes 56.

An integral arm 77 of member 52 is scured to lever 78. Lever 78 is connected via a connecting link 86 to a proportioning lever 84 adjacent one end of the lever 84 which is pivotable about stationary support 79. The other end 77 of lever 84 slidably engages a piston 88 of water pump 66. The piston is internally spring biased in such manner that the spring action forces an increase in the pump cylinder volume and therefore draws water into the pump cylinder by vacuum action. Thus, the pump is automatically charged with water. The pump is actuated by causing the piston to move inwardly into the cylinder against the force of the spring whereby water is pumped into pipes 56 as described.

A stop 87 on piston 88 limits the movement of end 77 in one direction. The end 77 is normally biased in the opposite direction by the action of spring 89. The end of piston 88 remote from the pump engages the upper of an essentially vertical cam follower 82. Follower 82 has a projecting prong 81 which engages the contoured periphery 83 of stationary cam 80. Follower 82 is pivotally secured at its lower end to a stationary support 85.

In use, the handle 54 is used to raise the member 52. Clothing or other fabric article to be pressed is placed upon surface 51. The handle 54 is then used to lower the member 52 onto member 50. Lever 78 is not touched at this point. The pressing action begins as the member 52 is lowered and continues until the article is squeezed between the lower surface of the platen and the upper surface 51 of member 50.

The purpose of the cam and cam follower is to control the timing of steam generation so that enough time elapses to allow steam discharged from the holes 62 to dissipate across the platen and to thoroughly permeate the article prior to completion of the squeezing action. If the dissipation time is not sufficient or too late some portions of the article will not receive sufficient steam and the subsequent pressing operation will not be satisfactory. On the other hand if the dissipation time is too early, steam will be dissipated above and will not permeate the article.

To this end, the pump is actuated during a predetermined interval t between the instant of time T1 at which the downward movement of member 52 toward member 50 is initiated and the instant of time T2 at which the article is squeezed between the members. The duration of the interval t is less than the duration of the interval between T2 and T1, that is the interval {T2−T1}.

Figure 5:
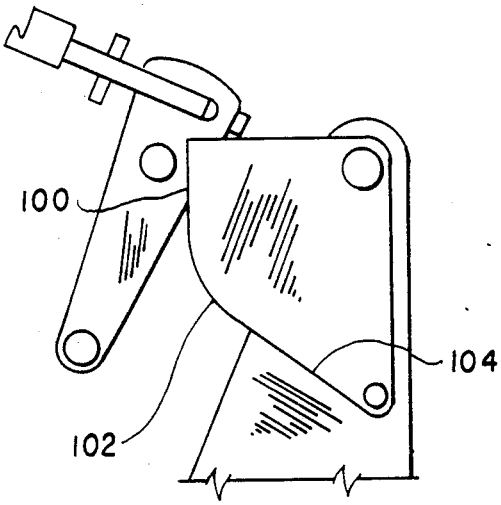
FIGS. 5–11 illustrate different cam follower positions for the cam of FIG. 4.
Figure 8:
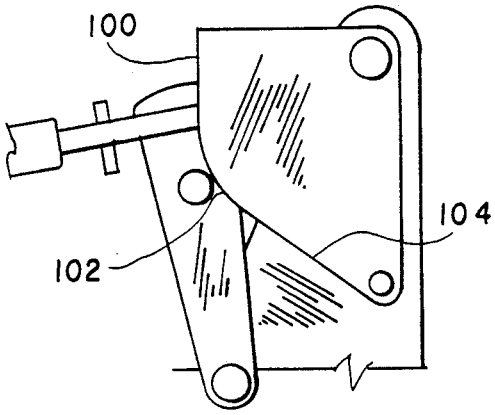
Figure 6:
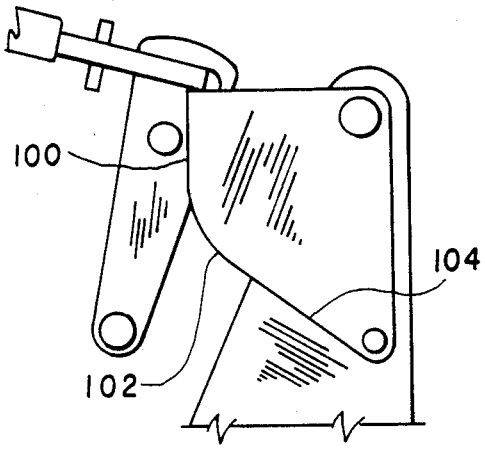
Figure 7:
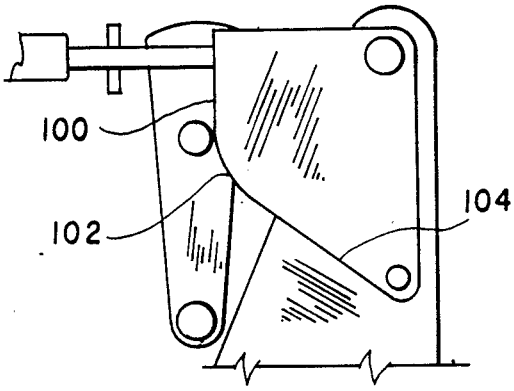
Figure 9:
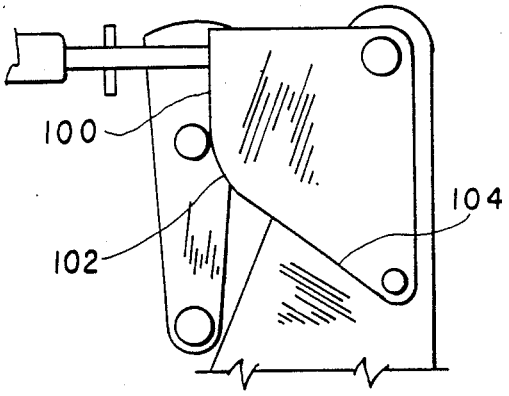
Figure 10:
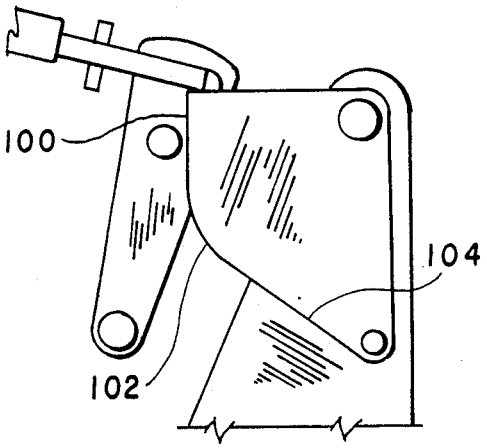
Figure 11:
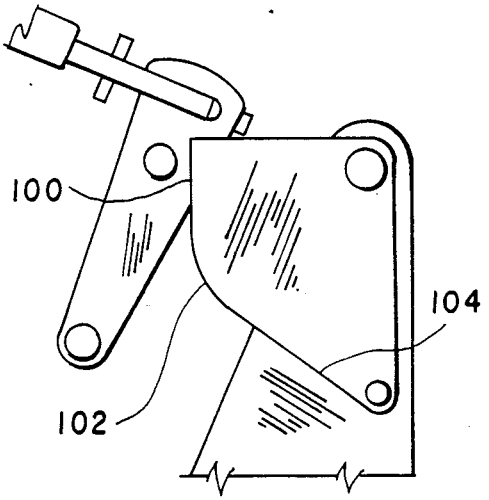

The control of the timing of pump actuation is illustrated in FIGS. 5–11. The peripheral edge of the cam has a vertical region 100, a curved region 102 and an inclined region 104. The pump is actuated only during the interval of time in which prong 82 engages region 102. Thus, at time T1, the prong is first separated from the cam and gradually moves toward the peripheral edge as shown in FIGS. 5 and 6. Interval t begins when the prong engages top of region 102 as shown in FIG. 7 and continues as the prong rides down along region 102, as shown in FIG. 8 and then reverses and moves upward along region 102 as shown in FIG. 7 and returns to the top of the region as shown in FIG. 9 at which point interval t ends. The prong then is disengaged from the cam as shown in FIG. 10 and returns to the original start position at time T2 as shown in FIG. 11. In this arrangement, the interval t can be modified so that interval t terminates at time T2.

The cam and follower action described above occurs when handle 54 and lever 78 move together. The operator can operate lever 78 independently of handle 54 while grasping handle 54 to provide an additional burst of steam at any point in the press cycle. When lever 78 is raised above handle 54, the actuating lever 84 causes the cam follower to pivot and move the prong into engagement with any adjacent portion of the peripheral edge of the cam wherby the pump is actuated to pump an additional amount of water into the steam chamber and is converted to steam. The benefit of this feature is to provide additional wetting of the fabric to further relax wrinkles or to "liven" high pile fabric without pressing.

By rotating control knob 106, the initial position of pivot of the actuating lever 84 can be caried to control the length of interval t and thus regulate the period and amount of steam generation.

We claim:

1. A steam iron press adapted to press an article of fabric and comprising:

first and second generally horizontal members, the first member being fixed in position and having an exposed upper surface, the second member having an exposed lower surface with openings therein and being movable toward and away from the first member so that the exposed lower surface is moved toward and away from the exposed upper surface, said article being disposed removably upon the upper surface for pressing, the pressing action ensuing when the second member is moved toward the first member until the article is squeezed between the two exposed surfaces;

a lever mechanism connected to the second member and when manually actuated by an operator causing said second member to be moved to any position between a position of maximum separation and a position of minimum separation (engagement) with respect to the first member;

said second member having means for receiving water supplied thereto and heating said water into steam, the steam being expelled through the openings in the lower surface, said means also heating said exposed lower surface so that when said article is squeezed it is pressed using heat and steam;

a water reservoir containing water;

a pump connected between said second member and said reservoir, said pump when actuated feeding water under pressure from the reservoir to said means and when deactuated preventing flow of water from said reservoir to said means; and a cam mechanism connected between the lever mechanism and the pump to actuate the pump during a predetermined interval t between the instant of time T1 at which the lever mechanism has initiated movement of the second member toward the first member and the instant of time T2 at which the article is squeezed between the two surfaces, the duration of the interval t being less than that of the interval (T2 – T1), said cam mechanism otherwise deactuating the pump.

2. The press of claim 1 wherein the interval t begins at an initial instant of time T3 which occurs after T1 and ends at a final instant of time T4 which occurs prior to T2.

3. The press of claim 2 wherein the instant of time T3 occurs after the movement of the second member toward the first member has begun and the instant of time T4 occurs prior to the initiation of the squeezing action to enable the steam expelled from the orifices to penetrate the entire article prior to the initiation of the squeezing action.

4. The press of claim 1 wherein the interval t begins at an initial instant of time which occurs after T1 and ends at a final instant of time coincident with time T2.

* * * * *